United States Patent [19]

Laws

[11] 4,288,174

[45] Sep. 8, 1981

[54] SYSTEM FOR GROUNDWATER FLOW CONTROL

[76] Inventor: Awbrey C. Laws, West Tisbury, Mass. 02175

[21] Appl. No.: 74,168

[22] Filed: Sep. 10, 1979

[51] Int. Cl.[3] ..... E02B 11/00

[52] U.S. Cl. ..... 405/43; 405/50; 405/129

[58] Field of Search ..... 405/36, 43, 50, 51, 405/128, 129

[56] References Cited

U.S. PATENT DOCUMENTS

| | | | |
|---|---|---|---|
| 587,779 | 8/1897 | Barker | 405/43 X |
| 870,433 | 11/1907 | Hodges | 405/50 |
| 4,171,921 | 10/1979 | Morfeldt | 405/128 |

FOREIGN PATENT DOCUMENTS

| | | | |
|---|---|---|---|
| 2755554 | 6/1978 | Fed. Rep. of Germany | 405/128 |

*Primary Examiner*—David H. Corbin

*Attorney, Agent, or Firm*—Wolf, Greenfield & Sacks

[57] ABSTRACT

A groundwater flow diversion system for reducing the rate of groundwater flow beneath a designated land area. The diversion system is comprised of one or more conduits located substantially around the circumference of a designated land area beneath the groundwater level so as to provide low resistance hydraulic connection to groundwater either continuously or at specified points of groundwater collection or discharge along the conduit structure. The diversion system reduces the groundwater potential energy differences between all points within the circumferential conduits and thereby reduces the rate of groundwater flow, essentially isolating the groundwater under the designated area from that outside of the construction.

The diversion system protects property and water supplies located downstream of a contaminated area from pollution caused by contaminants carried by groundwater flow passing beneath the contaminated land. The diversion system isolates groundwater beneath an area recharge of groundwater, thus protecting supplies from contaminants migrating into the recharge area along the groundwater flow. Therefore, sites can be designated for the storage of materials with greater assurance that they will not be distributed by groundwater flow.

5 Claims, 7 Drawing Figures

SYSTEM FOR GROUNDWATER FLOW CONTROL

BACKGROUND OF THE INVENTION

1. Field of the Invention

The present invention relates to a system for reducing the rate of flow of groundwater directly beneath a specific land area.

The present invention relates to a groundwater flow diversion system comprised of one or more low-resistance hydraulic conduits. The invention relates to lowresistance hydraulic conduits connecting collection and discharge sites located substantially around a circumference of a specific land area and place to provide hydraulic flow and equalization of groundwater potentials within the subject area.

2. Description of Prior Art

Groundwater flow may carry with it dissolved material which may be contaminants to downstream water supply. Also, groundwater passing beneath a contaminated area of land may become contaminated with leachate from the contaminated site and may consequently pollute water supplies and/or land property located downstream of the contamination site. Land fills, for instance, may generate highly polluted leachate which percolates into the groundwater and is carried beyond the land fill site to pollute land areas downstream of the land fill. It is desirable, therefore, to process the contaminated groundwater for managed removal and treatment of contaminants, or to isolate the contaminated land area from normal groundwater flow.

The prior art discloses expensive methods for sealing groundwater flow from the contaminated sites. One prior art method for isolating the contaminated area is by a construction of low-permeability barrier which effectively prevents passage of groundwater from the contaminated land site. These constructions involve much expense of materials and labor and are subject to possible degradation or disruption with the probability of unkown leakage. It also is impossible to provide such a barrier below exsting contaminated deposits without first physically removing the contaminated deposits. Another prior art system involves the placement of a horizontal barrier beneath an area designated to receive contaminants.

The present invention has overcome these disadvantages of the prior art by the placement of a permeable low-hydraulic resistance conduit into the groundwater surrounding the contaminated area. The placement of a permeable conduit system around a contaminated land area has been found to provide a comparatively simple and economical means for altering the route and rate of flow of groundwater passing beneath the contaminated area. The system of the invention has a further effect of containing the contaminated groundwater immediately below the contaminated site so that, essentially, contaminated water cannot escape from the site, is retained for possible withdrawal and treatment, and is less likely to pollute downstream property and downstream water supplies.

SUMMARY OF THE INVENTION

It is a principal object of the present invention to reduce the rate of flow of groundwater which passes beneath specific land areas.

It is an object of the present invention to reduce or eliminate contamination of land property located in the vicinity of a contaminated land area by reducing the rate of flow of groundwater which passes through and beneath contaminated land areas.

An additional object of the invention is to protect existing or newly-constructed groundwater supplies from contamination caused by groundwater passing beneath a contaminated land area and carrying contaminants to said existing or newly-constructed groundwater supply.

An additional object of the invention is to provide an area of land under which the groundwater flow is reduced so as to premit the permanent or temporary storage of liquids within the soil structure.

It has been determined that the placement of low-hydraulic resistance groundwater flow diversion system in communication with groundwater and placed substantially around the circumference of a specific land mass along points located below the upper level of the groundwater will significantly reduce the rate of groundwater flow through the land mass. The low-hydraulic resistance diversion system may be comprised of one or more low-hydraulic resistance permeable wall conduits placed into the groundwater along the circumference of a land mass through and above which the rate of groundwater flow is to be reduced.

Alternately, the groundwater flow diversion system may be comprised of a plurality of non-hydraulic permeable and/or hydraulic permeable wall conduits connected to wells located around the circumference of a land mass through which the groundwater flow is to be reduced. The permeable conduits are connected to the wells at points below the lowest groundwater level forming a continuous hydraulic connection and permitting groundwater to pass from the wells into said conduits.

The impermeable wall conduits may be connected to the wells below the lowest anticipated level of groundwater, or may be positioned as much as twenty five (25) feet above the lowest groundwater level, as long as the requirement of continuous hydraulic connection can be maintained by the venting or pumping of any gases from the conduit system. Placement of the conduits in this manner circumferentially around the land mass causes the groundwater in the land mass to substantially cease flowing. Surprisingly, it has been determined that placement of the conduits circumferentially around the land mass, to form a continuous arc of at least 180° around the circumference of the land mass will cause the groundwater in the land mass to substantially cease flowing. The wells are typically of approximately between two inches and eight inches in diameter, but may be as large as necessary to accommodate the flow. The wells may be packed with gravel or sand filler material forming an opening at a point within the groundwater so that the groundwater may pass into or out of the conduit through said opening. Alternatively, the well openings or permeable wall conduit may be covered with hydraulic permeable material such as engineering fabric or filter cloth or be constructed of permeable materials to permit passage of groundwater into said conduits without an accumulation of sediments within the conduits or wells. Alternatively, the groundwater flow diversion system may be constructed by channeling into the groundwater to provide an open trench with unimpeded flow of surface water into and from groundwater.

DESCRIPTION OF THE PREFERRED EMBODIMENT

Figure 1:
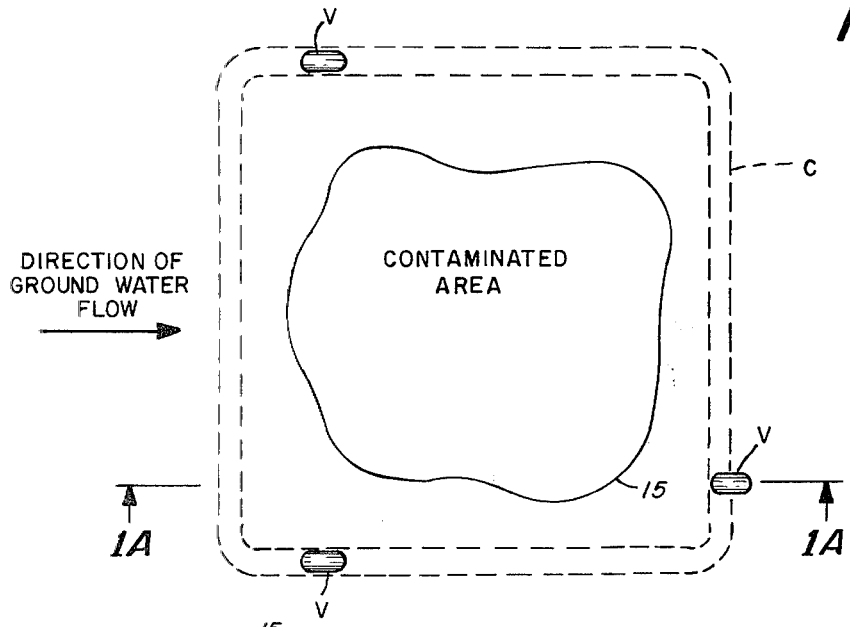
FIG. 1 is a plan view of a preferred embodiment employing a permeable wall conduit of the groundwater flow diversion system of the invention.
Figure 1A:
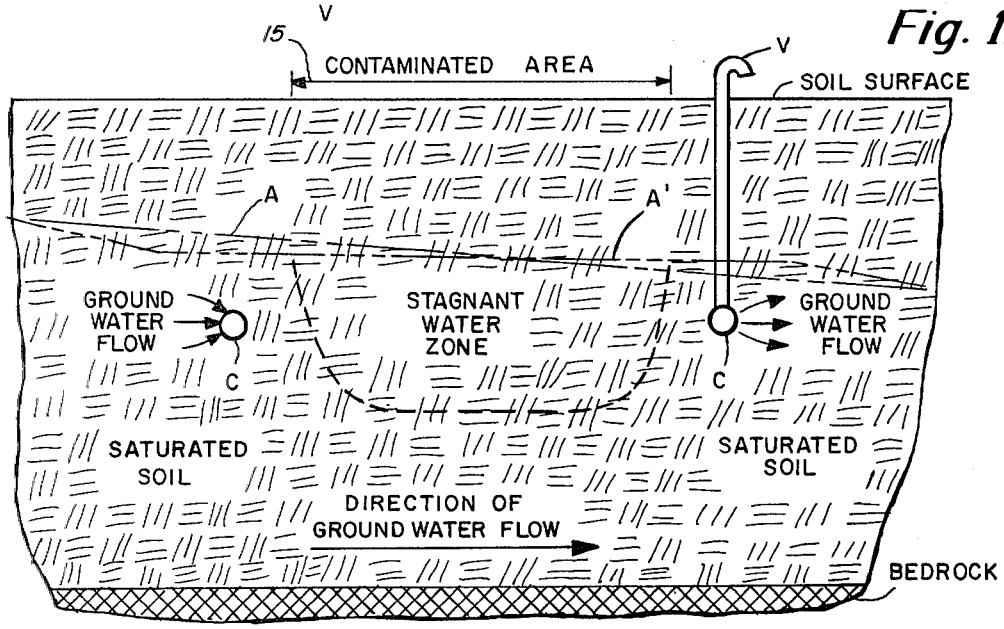
FIG. 1A is a sectional elevation view taken through site lines 1—1 of FIG. 1 illustrating the positioning of a conduit in relation to the groundwater.

A preferred embodiment of the groundwater diversion system of the invention is shown in FIGS. 1 and 1A. In this embodiment the groundwater flow diversion system consists of a porous conduit C, to and from which groundwater in the saturated soil may freely flow. The conduit C is placed into the saturated soil in the path of groundwater flow as illustrated in FIG. 1A and substantially surrounds the contaminated area 15 as illustrated in FIG. 1. The conduit C is fitted with vents, V, from which air and other gases can be discharged to prevent either reduction in hydraulic capacity or interruption of flow. The groundwater surface A which existed before placement of the conduit is distorted at equilibrium by the diverted flow to surface location A' which is essentially horizontal within the perimeter of the conduit. The reduction of elevational differences in the groundwater level reduces proportionately the energy required for groundwater flow within the conduit and a stagnant water zone is developed beneath the contaminated area 15. Materials and water draining from area 15 will collect in the stagnant water zone and be accessible for withdrawal, treatment or use.

Figure 2B:
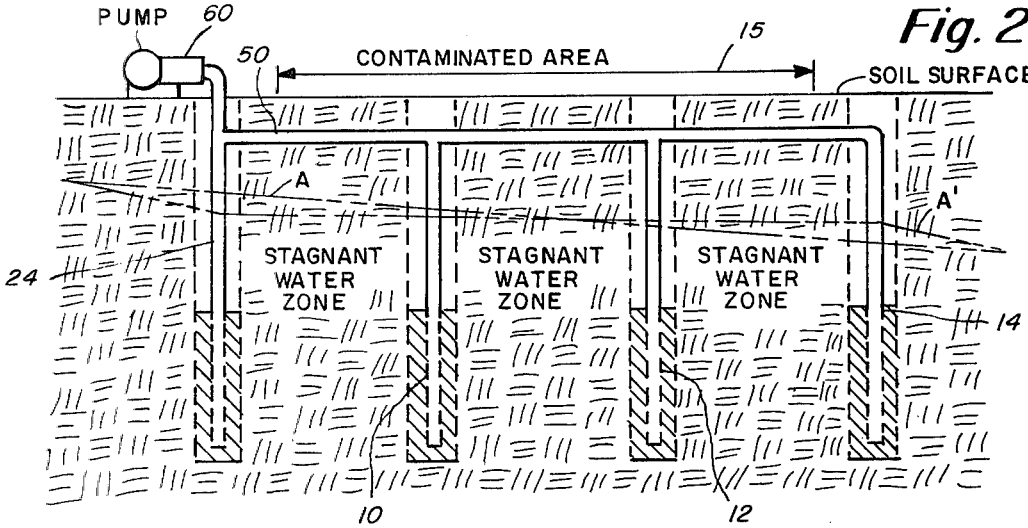
FIG. 2B is a sectional view also taken through site lines 2—2 of FIG. 2 illustrating the positioning of the conduit above groundwater level, and equipped with a means of assuring hydraulic continuity.
Figure 2:
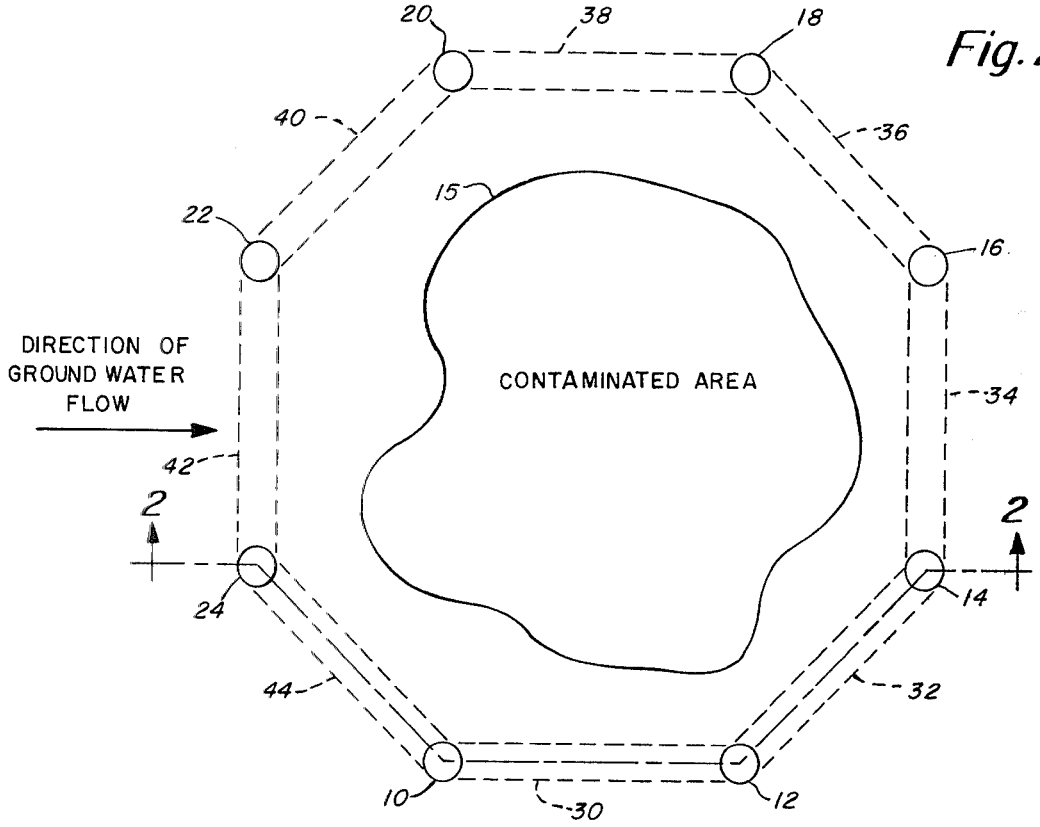
FIG. 2 is a plan view of an embodiment of the groundwater flow diversion system of the invention employing wells and impermeable conduits.
Figure 2A:
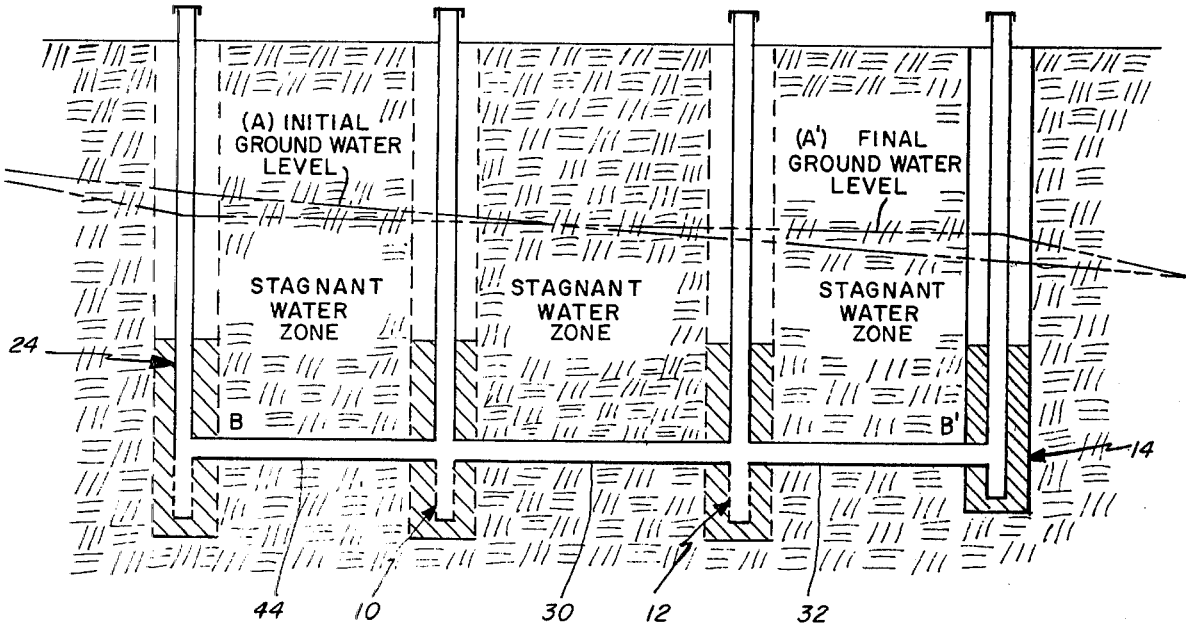
FIG. 2A is a sectional elevation view taken through site lines 2—2 of FIG. 2 illustrating the positioning of a conduit below the groundwater level in relation to the wells and the groundwater.

Another preferred embodiment of the groundwater diversion system of the invention is shown in FIGS. 2 and 2A. In this embodiment of the invention, the groundwater flow diversion system is comprised of a plurality of wells connected to each other by conduits arranged below the groundwater level around the contaminated ground area around which the flow of of groundwater is desired to be diverted. A plurality of wells such as wells 10, 12, 14, 16, 18, 20, and 24 surrounding a contaminated area 15 are formed from well-type excavations dug around the periphery of the contaminated area, under which area groundwater flows. The wells are located so that the line in influence of the initially resulting groundwater cones of depression at inlet sites and groundwater mounds at the discharge sites will be able to equilibrate at levels which will assure the desired degree of reduction in groundwater flow under the contaminated area 15. As groundwater levels and contours or potentials are known to move and reflect conditions beyond control at the site, it is preferred to distribute the wells rather uniformly around the site. The wells may be located in a geometrically regular or irregular pattern which is dictated by the specific site considerations. The wells are typically approximately between two inches and eight inches in diameter and may be as much as approximately four feet in diameter. FIG. 2A shows that the wells 24 and 14 are connected by horizontal conduits 44, 30, and 32 at a point B-B' located approximately between one and 20 feet preferably about five feet below the lowest surface of the groundwater level. The connection below the groundwater level of conduit 30 to the well 24 to conduit 44 to wells 10 and 12 and conduit 32 to well 14 is illustrated in FIG. 2. In similar manner, the other conduits are provided to connect all wells at points approximately horizontal and preferably below the groundwater level. The well holes are packed with hydraulic permeable material such as fine gravel with the conduits connected to well points or slotted pipe which may be capped below ground level or left exposed to serve as observation wells. Alternatively, solid pipes or concrete conduits may be placed with open ends in the well holes, said pipes or conduits located beneath the groundwater level to form an opening within the gravel filter of the well packing so that groundwater may flow and pass to the discharging wells through said conduit. The conduit may have an inside diameter of approximately between two inches and 24 inches.

The impermeable wall conduits may be connected to the wells below the lowest anticipated level of groundwater, or may be positioned as much as 25 feet above the lowest groundwater level, so long as the requirement of continuous hydraulic connection can be maintained by the venting or pumping of any gases from the conduit system. FIG. 2B is illustrative of a manner in which a continuous hydraulic connection can be maintained between the wells by connecting the wells by an overhead conduit 50, located at or near the well inlet end. The conduit 50 is also connected to pump suction means 60 employed to pump any gases from the conduit system. The size of the conduit, or conduits, is determined by a number of considerations. The design is based upon three essential parameters: (1) permeability of the soils through which the groundwater flows, (2) the boundary of the area to be managed and (3) the desired reduction in groundwater flow under the managed area. At equilibrium after construction, the sum of the conduit flow, $Q_c$, and reduced groundwater flow $Q_g$, will be nearly equal to the initial groundwater flow, $Q_i$:$Q_c+Q_g=Q_i$, if the flow is essentially controlled before reaching the construction by the geological and hydrological conditions. The maximum interception can be determined by flow net or suitable computer analysis and the conduits sized to accept that flow under the forces of the designed equilibrium gradient.

Alternatively, the conduits may be perforated or permeable constructions permitting the groundwater to penetrate the surface and flow into the conduits from and to external groundwater flow regions. The use of permeable conduits results in fewer wells connecting the conduits, that is, the wells may be located at greater distances apart or even entirely eliminated if such permeable conduits are employed. Permeable conduits of low-hydraulic resistance of the type suitable for use in the present invention may be of metal, plastic, ceramic, or concrete construction having, for example, open joints, holes or slot-type perforations or constructed of porous materials. Permeable conduits having a hydraulic reistance suitable for use in the present invention are described in U.S. Pat. Nos. 3,998,065 and 3,563,038. Alternatively, the permeable conduits may be comprised of a trench filled with layers of gravel and sand. This type of simple conduit may be advantageously employed when the soil permeability is very low.

The velocity of groundwater flow for which the present invention has particular application may be in a range between about $3\times10^{-5}$ to $3\times10^{-9}$ ft./sec. For groundwater flow rates within this range, application of the flow diversion system of the present invention will reduce by about 99 to 99.99% the rate of groundwater flow beneath a given land area. The present invention is not limited to the size of the land area beneath which the groundwater flow is diverted, but land areas between about 40,000 and 1,000,000 square feet in area have been determined to be particularly amenable to groundwater control by application of the present invention.

Figure 3:
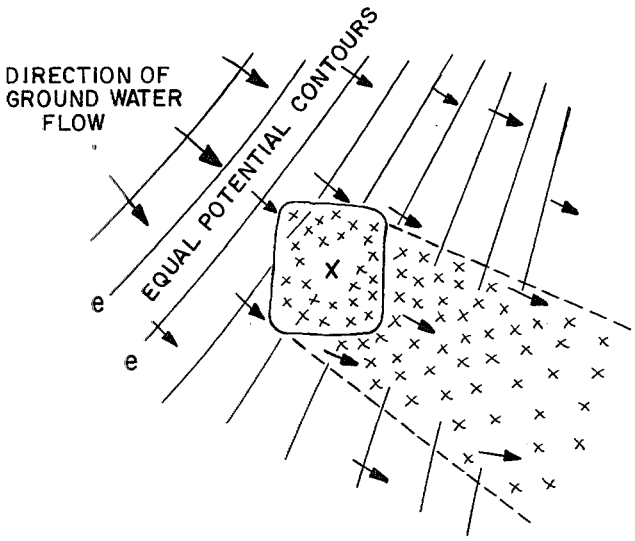
FIG. 3 is a schematic diagram illustrating the contaminated groundwater flow downstream of a contaminated land site prior to employing the present invention.
Figure 4:
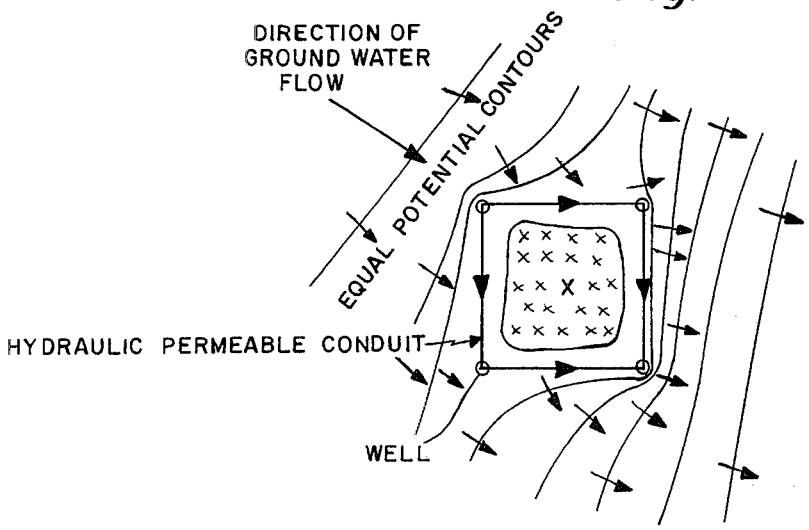
FIG. 4 is a schematic diagram illustrating the reduction of contaminated groundwater flow after employing the present invention around the contaminated site.

In operation, groundwater flows into the system of conduits and then passes through the conduits towards the downstream region of the groundwater flow diversion system. In the embodiment of the present invention employing perforated or permeable conduits, the groundwater flows into the conduits partially through the perforations located in the permeable conduit and partially through the well soil employed. The groundwater passes from the diversion system through outlets identical to the inlets. In the embodiments of the invention employing perforated or permeable conduits, but no wells to which conduits are connected, the groundwater passes into the conduits essentially through the perforations located along the conduit surface and passes from the system through similar perforations. When the system of the invention is placed into operation, the groundwater level above the conduits within the interior regions, bounded by the conduits, tends to equalize as shown in the final groundwater level mark in FIG. 2A. Surprisingly, the groundwater susbtantially ceases to flow in all regions of earth surrounded by the conduits. For example, referring to FIG. 2, the groundwater substantially ceases to flow horizontally in regions of earth located within the conduits and within the area bounded by conduits 30, 32, 34, 36, 38, 40, 42, and 44. Thus, the important result of operation of the present invention is that the contaminated groundwater ceases to flow, that is, becomes substantially stagnant in all regions within the conduit. Therefore, essentially, only clean uncontaminated groundwater passes through the conduits and discharges from the diversion system. Since the contaminated water is contained within a defined region, the present invention, in effect, substantially alleviates the pollution of regions of land and water supplies located downstream from a given contaminated area of property, where the pollution of such downstream sites is caused by flow of underground water beneath a contaminated land area. The results obtained by the operation of the present invention may be seen from the graphic description of groundwater (phraetic) contours illustrated in FIGS. 3 and 4. The FIG. 3 illustrates the concentration of contamination to downstream sites when the present invention is not used. For example, contamination of said sites in FIG. 3 is caused by underground water flow beneath a contaminated area 15. FIG. 4 illustrates the effect of the present invention on the flow of groundwater beneath the contamination site X. FIG. 4 illustrates that the equal potential groundwater contour lines defined as the line along which there is no groundwater flow (flow when it occurs will be perpendicular to equal potential lines) have become substantially altered around the contamination site when the system of the present invention is employed. The result is a stagnant rather than flowing contaminated water accumulation beneath site X, and consequently, a much reduced or negligent contamination of land areas downstream of contamination site X since the contaminated groundwater has substantially ceased flowing.

By employing the foregoing embodiments of the invention, groundwater pollution caused by the presence of a contaminated area of land has been confined to a region of stagnant groundwater immediately below the contamination site and contaminated water does not pass to property or water supplies downstream of the contamination site.

The use of the present system of the invention to confine contamination to a defined body greatly facilitates the task of treating contaminated property and adequately protects property downstream of a contaminated land area.

Although the present invention has been described primarily with reference to diverting groundwater flowing beneath a contaminated land site, it should be apparent that the invention is equally suitable to diverting groundwater beneath any land area to create a stagnant groundwater pool beneath said land area even though the land mass is not contaminated.

Although the invention has been described with reference to a system of conduits lying approximately in a singular plane, it should also be recognized that additional layers of conduits surrounding a given land mass below the groundwater level may be employed and, further, that this invention may be employed in confined as well as unconfined aquifers without departing from the scope of the invention.

What I claim is:

1. A system for virtually stopping the horizontal rate of groundwater flowing through and above a land mass, said system comprising means defining a plurality of adjacent approximately vertical well defining means located substantially along the circumference of the land mass and penetrating earth from a point at or below ground surface to a point at which substantial quantities of groundwater can be collected, said adjacent well means being connected to each other by conduits at connecting locations along said means forming at least 180 degrees of continuous conduit arc around said land mass, the connecting locations being approximately one foot to twenty feet below the upper level of said groundwater, said system functioning to virtually stop the horizontal flow rate of groundwater through said land mass and to virtually stop the rate of groundwater flow in subsurface land located in the region defined by the conduit arc and the groundwater level.

2. A system as in claim 1 wherein the adjacent well defining means are spaced about ten to 100 feet apart and are approximately ½ to 12 inches in inside diameter, said conduits have an inside diameter of between 2 and 24 inches, said conduits connected to pumping means to remove gases from said well means and to maintain hydraulic continuity between said well means.

3. A system as in claim 2 wherein the well means are packed with hydraulic permeable material and the conduits are constructed of low resistance hydraulic permeable material.

4. A system as in claim 2 wherein solid pipes of approximately between two and 24 inches inside diameter are placed into the well means, the upper end of said pipe terminating at a point below the topmost groundwater level, but yet being within the path of the groundwater flow.

5. A system as in claim 2 wherein the conduits connecting said adjacent well means are in the form of a gravel filled trench.

* * * * *